US008512086B1

(12) United States Patent
Charczuk

(10) Patent No.: US 8,512,086 B1
(45) Date of Patent: Aug. 20, 2013

(54) PROPULSION DEVICES

(76) Inventor: Gregory John Charczuk, Milbridge, ME (US)

( * ) Notice: Subject to any disclaimer, the term of this patent is extended or adjusted under 35 U.S.C. 154(b) by 404 days.

(21) Appl. No.: 12/757,077

(22) Filed: Apr. 9, 2010

Related U.S. Application Data

(60) Provisional application No. 61/212,524, filed on Apr. 13, 2009.

(51) Int. Cl.
*B63H 16/04* (2006.01)

(52) U.S. Cl.
USPC ..... 440/101; 440/6; 416/74

(58) Field of Classification Search
USPC ..... 440/6, 53, 71, 72, 101; 416/70 R, 416/72, 74
See application file for complete search history.

(56) References Cited

U.S. PATENT DOCUMENTS

| | | | | |
|---|---|---|---|---|
| 827,202 | A * | 7/1906 | Bachman | 440/53 |
| 1,512,391 | A | 10/1924 | Abraham | |
| 1,953,599 | A | 4/1934 | Grimes | |
| 3,498,253 | A | 3/1970 | Wood, Jr. | |
| 5,908,339 | A | 6/1999 | Vassoff | |
| 5,993,274 | A * | 11/1999 | Rising et al. | 440/53 |
| 6,234,854 | B1 * | 5/2001 | Rydzewski | 440/53 |
| 2007/0224894 | A1 * | 9/2007 | Kudrna | 440/101 |

* cited by examiner

*Primary Examiner* — Lars A Olson
(74) *Attorney, Agent, or Firm* — Patricia M. Mathers

(57) ABSTRACT

A propulsion device includes a shaft and a paddle-like blade connected to a first end of the shaft. An electric motor is mounted on the paddle-like blade, and a propeller is attached to the electric motor. A power source electrically connected to the motor is also provided.

18 Claims, 5 Drawing Sheets

PROPULSION DEVICES

CROSS REFERENCES TO RELATED APPLICATIONS

This application claims the benefit of U.S. Provisional Application No. 61/212,524, filed Apr. 13, 2009, which is hereby incorporated by reference.

BACKGROUND OF THE INVENTION

This invention relates generally to propulsion devices and more particularly to handheld, self-contained propulsion devices for small watercraft.

Small watercraft such as canoes, kayaks and row boats are traditionally propelled by manual paddling or rowing. While simple and inexpensive, manually paddling or rowing can be laborious and physically exhausting. Paddling or rowing against a fast moving current or a strong wind is especially challenging. Many people have minor physical disabilities that make paddling or rowing impractical or even impossible.

Some small watercraft, such as dinghies or skiffs used to ferry people between shore and boat, utilize some manner of an internal combustion engine as the primary means of propulsion. However, such engines are expensive, noisy and frequently in need of costly repairs. The user must constantly buy fuel for the engines, lug heavy fuel cans around, and mix in fuel additives. Trolling motors overcome some of the disadvantages of internal combustion engines, but must be affixed to the boat. And even though most trolling motors can be swung out of the water when not in use, the unit typically remains attached to the boat and can thus be in the way of the people on the boat. Trolling motors require a marine battery, which can be expensive, and are generally not portable or easy to stow when not in use.

Accordingly, a propulsion device that overcomes the above-mentioned problems would be beneficial.

SUMMARY OF THE INVENTION

The above-mentioned need is met by the present invention, one embodiment of which provides a propulsion device having a shaft and a paddle-like blade connected to a first end of the shaft. An electric motor is mounted on the paddle-like blade, and a propeller is attached to the electric motor. A power source electrically connected to the motor is also provided.

The handheld propulsion device of the present invention can provide many beneficial uses, including, but not limited to: (1) aiding or assisting persons operating small watercraft such as canoes, kayaks, etc. by providing a means of motorized propulsion during foul weather or other difficult conditions; (2) for commercial fishermen and pleasure boaters who moor vessels offshore, providing an alternative method of transport from ship to shore that eliminates the burdens of using traditional gas-powered engines and the use of fossil fuels; (3) providing emergency backup equipment that can be operated from a boat's existing battery supply; and (4) being included as standard equipment packed inside other lifesaving equipment such as a rescue raft for open water survival situations.

DETAILED DESCRIPTION OF THE INVENTION

Figure 1:
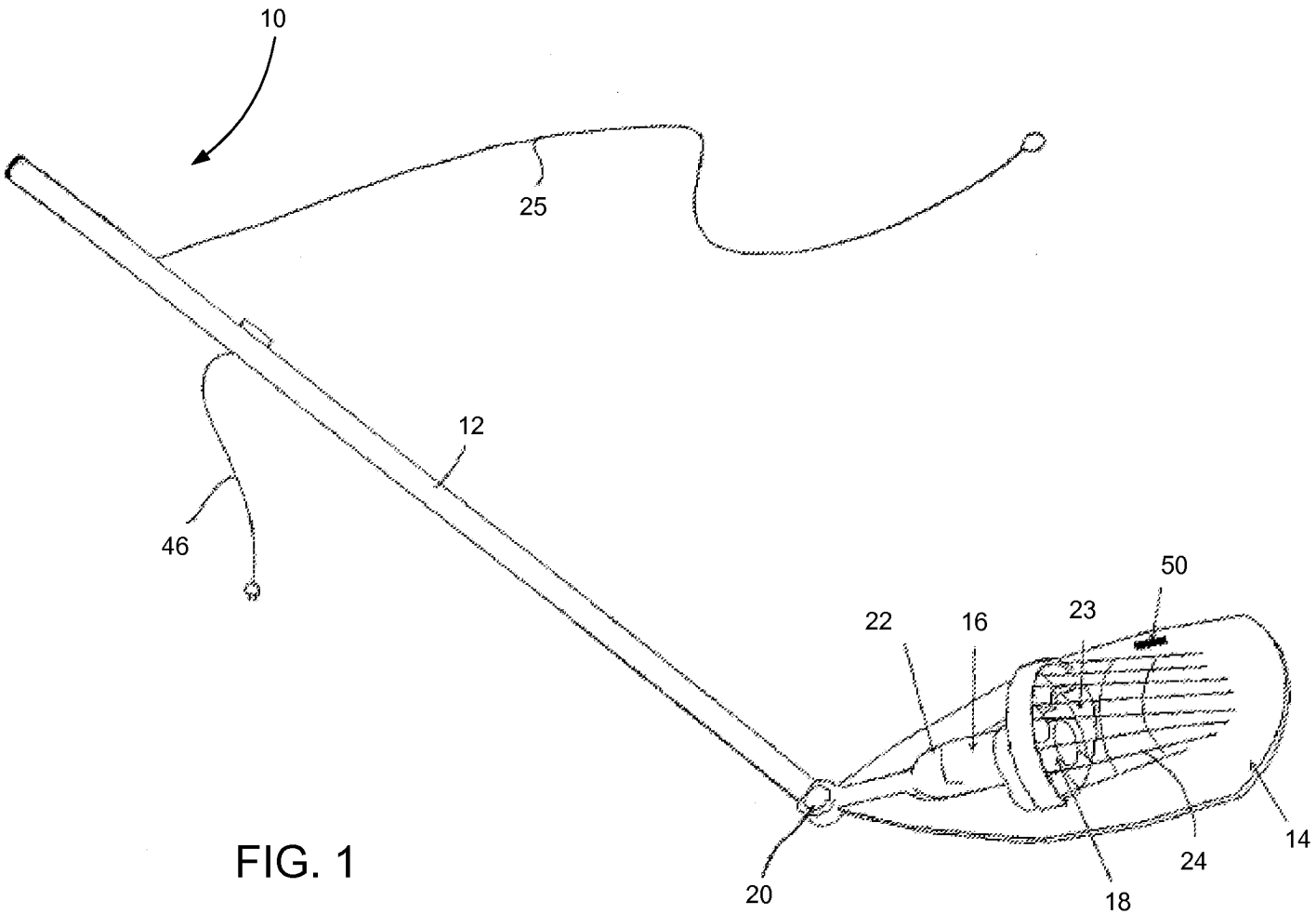
FIG. 1 is a perspective view of one embodiment of a propulsion device.
Figure 2:
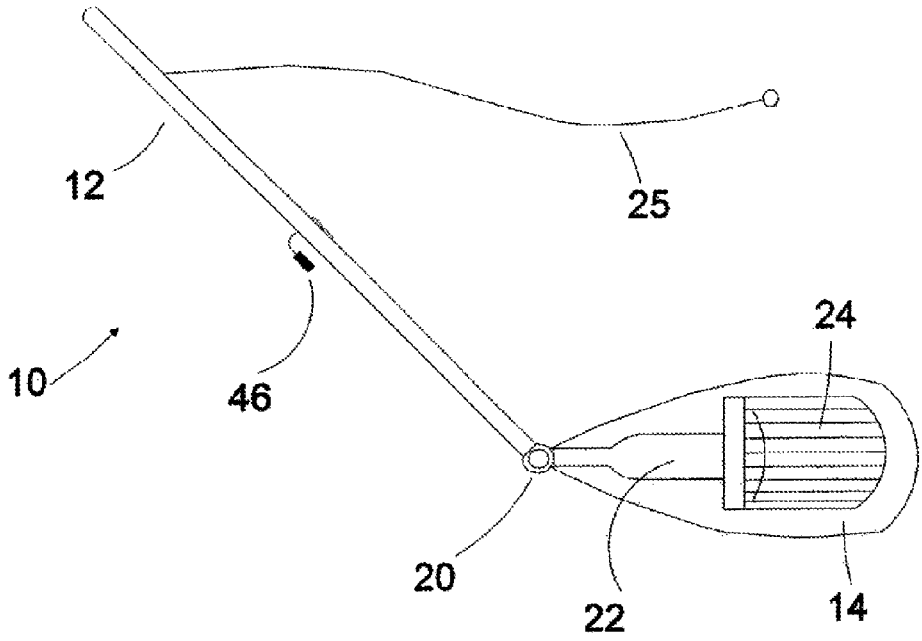
FIG. 2 is a side view of the propulsion device.

Referring to the drawings wherein identical reference numerals denote the same elements throughout the various views, FIGS. 1 and 2 show one embodiment of a handheld, self-contained propulsion device 10. The propulsion device 10 is portable and configured to somewhat resemble a paddle or oar (with the exception of the blade being angled) used to manually propel small watercraft such as canoes, kayaks, row boats, dinghies and the like. The propulsion device 10 includes a long shaft 12 and a paddle-like blade 14 attached to a first end of the shaft 12. As used herein, the term "paddle-like blade" refers to a relatively flat, broad component that resembles the blade of a paddle or oar. As seen in the drawings, the paddle-like blade 14 has a tapered aft portion and a broad forward portion. The tapered aft portion is connected to the shaft 12 and expands to the full width of the forward portion. The full width of the blade 14 is substantially wider than the shaft 12—generally, the full blade width will be at least 2-10 times greater than the shaft diameter or thickness. While the blade 14 is shown as being symmetrical about its longitudinal axis, it should be noted that asymmetrical blade configurations are also possible. An electric motor 16 is mounted on the blade 14, and a propeller 18 is attached to the motor 16. When activated, the motor 16 turns the propeller 18 to produce thrust.

The shaft 12 functions as an elongated handle, allowing a user on a watercraft to hold the propulsion device 10 overboard with the blade 14 and motor 16 submerged in the water. To this end, the shaft 12 is sized (i.e., in diameter or thickness) to be easily grasped by hand and is of sufficient length to enable the blade 14 and motor 16 to be submerged in the water while a user on the watercraft is holding the shaft 12. In the illustrated embodiment, the paddle-like blade 14 is pivotally connected to the first end of the shaft 12 by a lockable pivot joint 20. This allows the user to set the angle between the longitudinal axis of the blade 14 and the longitudinal axis of the shaft 12 as desired for optimum performance. Generally, the angle is preferably set such that the motor 16 is oriented horizontally when the user is comfortably holding the propulsion device 10 overboard with the motor 16 submerged to the desired depth below the waterline. As an alternative to a pivot joint, the paddle-like blade 14 can be joined to the first end of the shaft 12 by a fixed joint wherein its longitudinal axis is oriented at an oblique angle (i.e., neither perpendicular nor parallel) with respect to the longitudinal axis of the shaft 12. The fixed oblique angle is set at an angle that will allow, in most applications, the user to comfortably hold the propulsion device 10 with the motor 16 oriented horizontally while deployed. This angle will generally be in the range of about 120-140 degrees.

Figure 3:
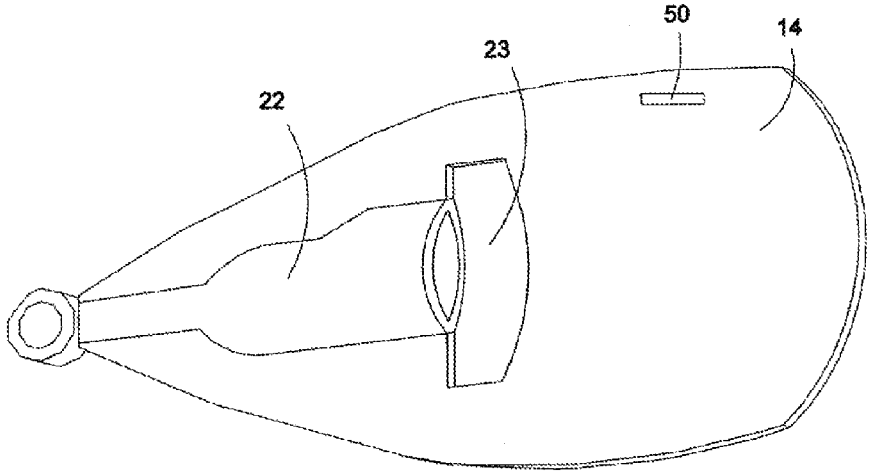
FIG. 3 is an enlarged view of the paddle-like blade (with the motor removed) of the propulsion device.

As best seen in FIG. 3, the paddle-like blade 14 has an integral housing 22 formed thereon for receiving the motor 16. The housing 22 is situated on the blade's longitudinal axis and extends from the aft end of the blade 14 to a point near the center of the blade 14. The housing 22 is entirely enclosed except for being open at the end near the blade center. An opening 23 is formed in the blade 14 adjacent to the open end of the housing 22. The electric motor 16 is mounted in the housing 22 with its output shaft positioned substantially parallel to the longitudinal axis of the blade 14 and extending into the opening 23. The propeller 18 is mounted on the output shaft and is located in the opening 23, oriented perpendicular to the longitudinal axis of the blade 14. A protective cage or shield 24 entirely encloses the propeller 18 while still permitting water to flow through. The electric motor 16 is a lightweight, waterproof motor, or if not waterproof, is sealed in the housing 22 in a waterproof manner so as to be submersible. Any of a number of commercially available trolling motors would be suitable. Such commercially available motors are generally 12 volt or 24 volt DC motors. Motors other than trolling motors can also be used. In the illustrated embodiment, the motor 16 is a two-speed motor that is activated by one or more switches (described below) mounted on the shaft 12, although it should be noted that single speed and variable speed motors can also be used.

The blade 14 is preferably, but not necessarily, made to be buoyant. This could be accomplished by constructing the blade 14 as a hollow structure and/or making the blade 14 of a buoyant material. Suitable buoyant materials include foams, plastics and composites such as a composite of fiberglass and polystyrene foam. Ideally, the blade 14 will provide sufficient buoyancy so as to make the entire propulsion device 10 buoyant, in which case the propulsion device 10 will float. This allows the propulsion device 10 to be retrieved if it inadvertently falls into the water. In addition, or as an alternative to buoyancy, the propulsion device 10 has a tether 25 attached thereto, preferably, but not necessarily, to the shaft 12. The free end of the tether 25 can be attached to the watercraft or an object onboard, which would allow the propulsion device 10 to be retrieved in the event it falls into the water.

Figure 4:
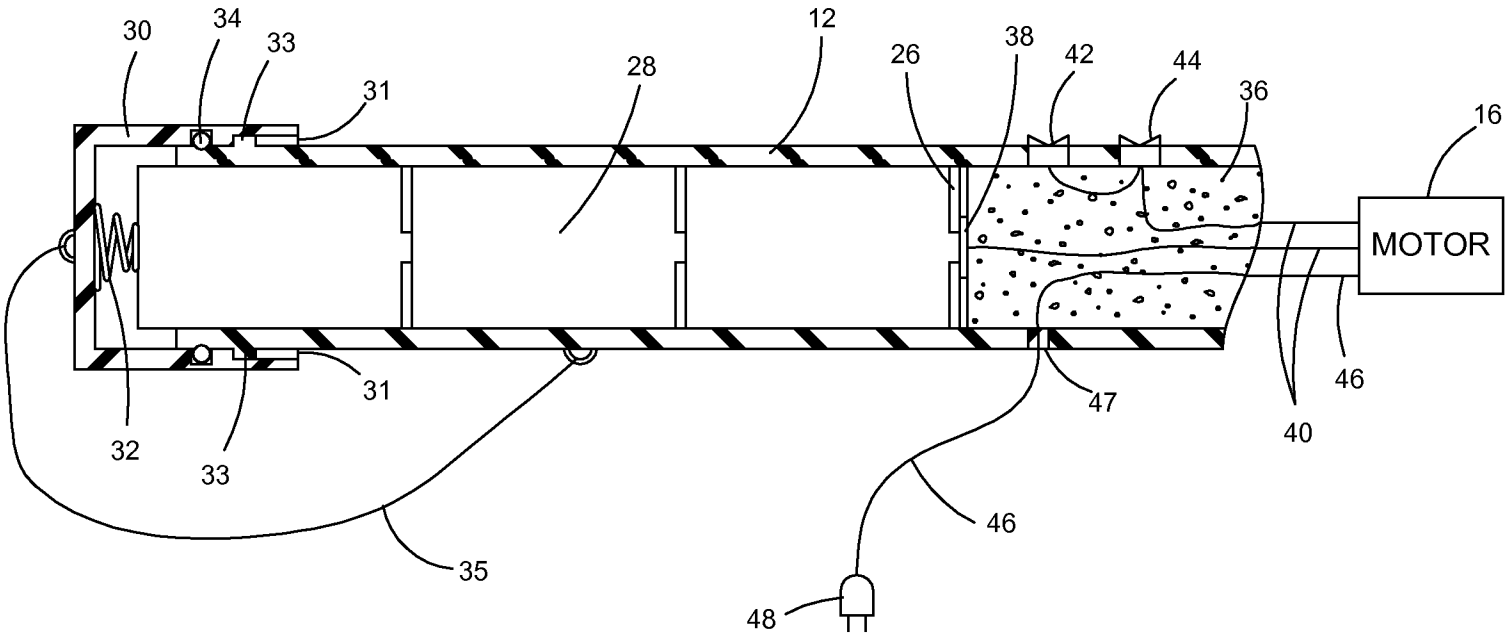
FIG. 4 is a cross-sectional view of a portion of the shaft of the propulsion device.
Figure 5:
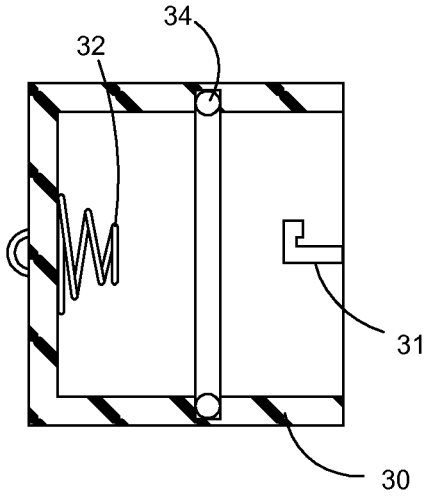
FIG. 5 is a cross-sectional view of one embodiment of an end cap used with the propulsion device.

Turning to FIG. 4, the shaft 12 is a hollow tube made from a sturdy, lightweight material such as aluminum, plastic, composites or the like and is typically, but not necessarily, cylindrical. The second end of the shaft 12 (the end opposite the blade 14) defines an internal, watertight compartment 26 that houses a power source 28. The compartment 26 is closed off by an end cap 30, which can be removed to provide access to the compartment 26. In the illustrated embodiment, the end cap 30 comprises an end wall and a cylindrical side wall, which fits over the second end of the shaft 12. Two J-shaped slots 31 (one shown in detail in FIG. 5) are formed in the inner surface cylindrical side wall, and a spring 32 is mounted on the inner surface of the end wall. Two nubs 33 are located on the outer surface of the shaft 12, near the second end, in complimentary positioning relative to the slots 31. The end cap 30 is locked onto the shaft 12 with a push-and-twist motion. That is, the end cap 30 is pushed onto the second end of the shaft 12 against the spring force, with each nub 33 being received in the corresponding slot 31, and then twisted so that the nubs 33 are received in the offset portions of the slots 31, thereby locking the end cap 30 onto the shaft 12. This operation is reversed to remove the end cap 30. An O-ring 34 is disposed between the inner wall of the end cap 30 and the outer shaft wall to establish a watertight seal therebetween. A short retaining tether 35, such as a strap, chain or cable, is connected between the end cap 30 and the shaft 12 to prevent the end cap 30 from becoming lost or misplaced when disconnected from the shaft 12. The hollow portion of the shaft 12 between its first end and the compartment 26 can be packed with a lightweight material 36, such as polystyrene foam or the like, to impede water ingress into the interior of the shaft 12. This will enhance the buoyancy of the device 10.

The power source 28 can be a replaceable battery pack comprising a plurality of rechargeable batteries. When the battery pack 28 becomes discharged, the user can disconnect the end cap 30, remove the spent battery pack (which extends slightly beyond the end of the shaft 12 so as to be easily grasped), insert a freshly-charged battery pack, and replace the end cap 30. The power source 28 could alternatively comprise a specially-adapted rechargeable battery. When disposed in the compartment 26, the positive terminal of the power source 28 contacts an electrical contact 38 in the bottom of the compartment 26, and the spring 32 attached to the end cap 30 contacts the negative terminal of the power source 28. The contact 38 is electrically connected to the motor 16 via wiring 40. In illustrated embodiment, the device 10 includes two waterproof switches mounted on the exterior of the shaft 12: an on-off switch 42 and a high/low speed switch 44. The two switches 42, 44 are electrically connected in series to the motor 16 via the wiring 40. The electric circuit is completed by the negative terminal of the power source 28 being in contact with the spring 32, which is electrically connected to the end cap 30, which is in turn electrically connected to the shaft 12 and the switches 42, 44. To activate the motor 16, the on-off switch 42 is switched to on, and the high/low speed switch 44 is switched to the desired speed. One or both of the switches could be provided with safety covers to prevent the motor 16 from being accidently activated. The electric circuit can also be provided with a fuse (not shown) disposed inside the shaft 12.

The propulsion device 10 includes an external power cable 46. The power cable 46 passes through a watertight aperture 47 (such as a plastic or rubber grommet) in the shaft 12 so that one portion is disposed inside of the shaft 12 and the other portion is located externally of the shaft 12. The internal portion of the power cable 46 is connected to the motor 16, and a connector 48 (such as a two-prong connector) is attached to the end of the external portion of the power cable 46. The power cable 46 thus provides an alternative, external means for powering the motor 16. For example, watercraft having a gas-powered motor typically have an onboard marine battery. The propulsion device 10 can be connected to the boat's battery by connecting the connector 48 to the battery terminals, such as with alligator clips. In this case, the power provided by the boat's battery would override the power source 28 (which could be removed when using the power cable 46) to power the motor 16. Thus, if the boat's motor runs out of fuel or breaks down for some reason, the propulsion device 10 can be used as an emergency backup to the primary motor.

Figure 6:
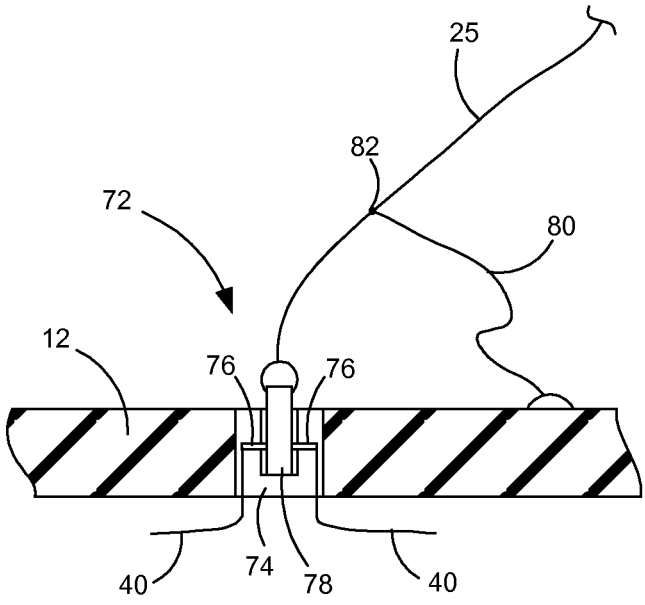
FIG. 6 is a cross-sectional view of one embodiment of a kill switch used with the propulsion device.

The propulsion device 10 can include a kill switch that provides the safety feature of killing or deactivating the motor 16 in the event the propulsion device 10 is dropped overboard while the motor 16 is running. Referring to FIG. 6, one possible embodiment of a kill switch 72 that works in conjunction with the tether 25 is shown. The kill switch 72, which is connected in series with the switches 42, 44, includes a socket 74 set into the wall of the shaft 12. The socket 74 includes a pair of electrical contacts 76 that are connected to the wiring 40. The socket 74 receives a pin 78 that is made of an electrically conductive material and is connected to the tether 25. When positioned in the socket 74, the pin 78 electrically connects the contacts 76, thereby closing the kill switch 72. The kill switch 72 is opened when the pin 78 is removed from the socket 74 so that the motor 16 cannot be activated. A secondary line 80 is connected to the shaft 12 and to the tether 25 at a connection point 82. The length of the secondary line 80 is greater than the length of the tether 25 between the pin 78 and the connection point 82. Thus, when the tether 25 is pulled taut (such as would happen when the propulsion device 10 falls overboard with the motor 16 running), the pin 78 would be pulled out of the socket 74 so as to deactivate the motor 16, but the tether 25 would remain connected to the shaft 12 via the secondary line 80.

Another possible safety feature is to provide a water sensor 50 on the paddle-like blade 14. The water sensor 50, many suitable ones of which are commercially available, is designed to be triggered when submerged in water. Generally, the water sensor 50 has two contacts. When submerged the water sensor 50 is in water, the water (which conducts electricity) creates a bridge between the contacts. So when the water sensor 50 is submerged in water, its contacts are closed, and when the water sensor 50 is not submerged in water, its contacts are open. The water sensor 50 is connected to a relay disposed inside the shaft 12 and forming part of the electric circuit of the motor 16, the power source 28, and the switches 42-44. Accordingly, when the water sensor 50 is submerged in water, it triggers the relay, which in turn allows the motor 16 to run when the switches 42-44 are engaged. But when the water sensor 50 is not submerged in water, the relay is not triggered, and the motor 16 will not run even when the switches 42-44 are engaged. As a consequence, the motor 16 can be operated only when deployed in the water and cannot be accidentally activated when not deployed. The water sensor 50 is preferably located on the upper edge of the blade 14 (i.e., the blade edge facing the angled shaft 12) so that the blade 14 and the motor 16 must be fully submerged for the water sensor 50 to be triggered.

Figure 7:
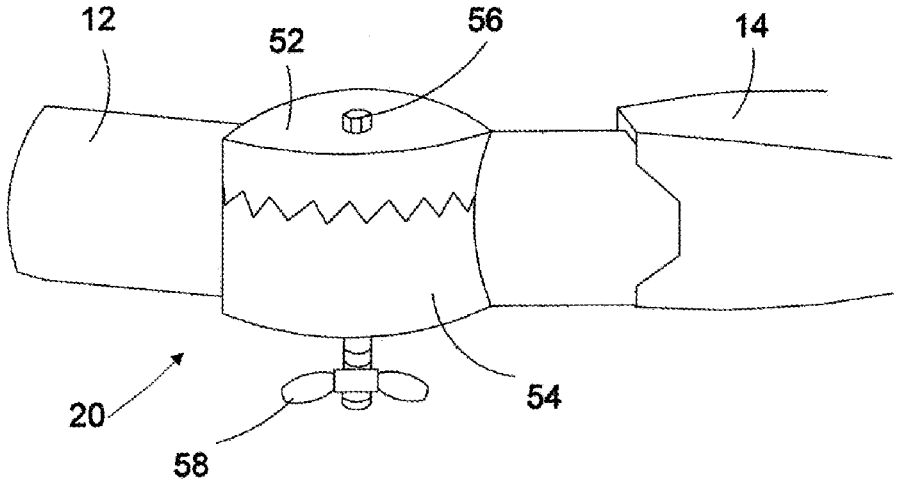
FIG. 7 is a perspective view of one embodiment of a lockable pivot joint used with the propulsion device.

FIG. 7 shows one possible embodiment of the lockable pivot joint 20. As illustrated, the lockable pivot joint 20 comprises a first joint element 52 fixed to the end of the shaft 12 and a second joint element 54 fixed to the aft end of the paddle-like blade 14. Each joint element is a generally circular disc having a planar outer surface and a ridged inner surface. Each ridged surface has a circular pattern of alternating crests and valleys (defining radially extending, uniform ridges) formed thereon. The joint elements 52, 54 are arranged so that the mating ridged surfaces are facing one another. A threaded bolt 56 extends axially through the center of both joint elements 52, 54, and a wing nut 58 is threaded on the bolt 56. When the ridged surfaces of the joint elements 52, 54 are mated together with the shaft 12 and the blade 14 at the desired relative angle, the wing nut 58 is tightened down to lock the pivot joint 20. The joint elements 52, 54 cannot be rotated or turned relative to each other due to the crests and valleys engaging or meshing like gear teeth. The angle can be adjusted by loosening the wing nut 58 so that the opposing crests and valleys can be disengaged, thereby allowing the pivot joint 20 to be set to a new angular position.

In operation, the user works the lockable pivot joint 20 to set the desired angle between the blade 14 and the shaft 12. The propulsion device 10 is then deployed by submerging the blade 14 and the motor 16 in the water to the desired depth. The user holds the shaft 12 in a position such that the motor 16 is oriented substantially horizontally in the water. The user then activates the motor 16 by switching the on-off switch 42 on and switching the high/low speed switch 43 to the desired speed. During operation, the user can steer the watercraft by turning the shaft 12 to change the direction of the thrust produced by the motor 16. Turning the shaft 12 also turns the blade 14, which functions like a rudder and steers the watercraft. The high/low speed switch 43 can be manipulated during operation to change the motor speed.

Figure 8:
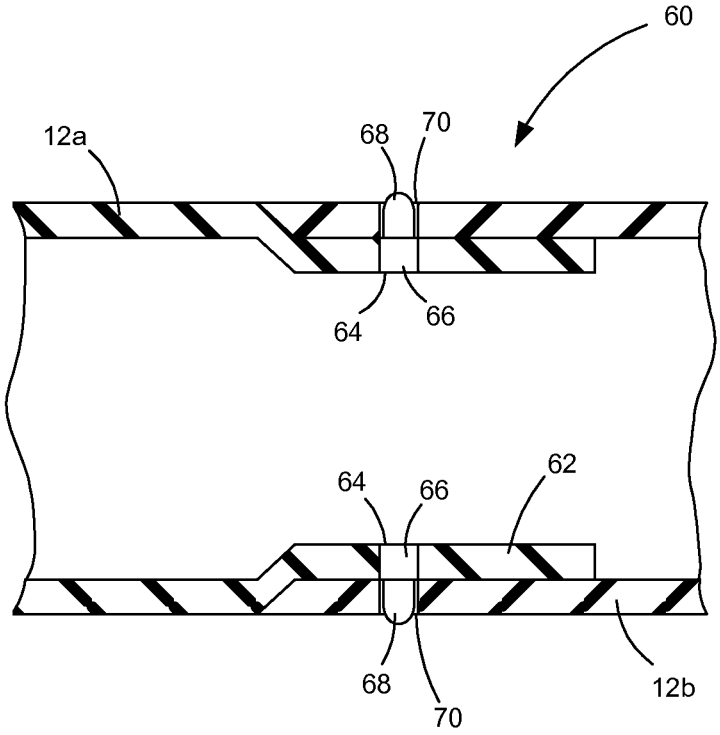
FIG. 8 is a partial cross-sectional view of a two-piece shaft having one embodiment of a quick connect coupling.

When not in use, the propulsion device 10 can be broken down for easy storage. The blade 14 can be separated from the shaft 12 by unscrewing the wing nut 58 and removing the bolt 56. The shaft 12 can also be made of two separable sections. For example, FIG. 8 shows one possible embodiment of a two-piece shaft comprising a first section 12*a* and a second section 12*b* joined together by a quick connect coupling 60. The first section 12*a* has a reduced diameter portion 62 at one end thereof that fits snugly in the open end of the second section 12*b*. The quick connect coupling 60 includes two spring-biased pin assemblies 64. Each pin assembly 64 comprises a body 66 fixedly mounted in the reduced diameter portion 62 and a pin 68 slidably received in the body 66, spring-biased to extend radially outward. Corresponding holes 70 formed in the second section 12*b* receive the pins 68 when the reduced diameter portion 62 is inserted into the second section 12*b*, thereby retaining the two sections 12*a*, 12*b* together. The sections 12*a*, 12*b* are easily separated by pressing the pins 68 into the respective bodies 66 against the spring bias while pulling the sections 12*a*, 12*b* apart in the axial direction.

With this arrangement, one of the sections 12*a*, 12*b* (i.e., the section that is not connected to the blade 14) could contain the power source 28 retained therein in a generally non-removable manner. This would eliminate the need for the end cap 30 for accessing and removing the power source 28. Instead, the section containing the power source 28 would function as a replaceable battery pack, as well as a section of the shaft 12. When the power source 28 becomes discharged, the user could remove the section containing the power source 28 and replace it with a section containing a charged power source 28.

While specific embodiments of the present invention have been described, it should be noted that various modifications thereto can be made without departing from the spirit and scope of the invention as defined in the appended claims.

What is claimed is:

1. A propulsion device comprising:

a shaft;

a paddle blade pivotably connected to a first end of said shaft for controlling direction of travel of a watercraft in water:

an electric motor mounted on said paddle blade;

a propeller attached to said electric motor;

a power source electrically connected to said motor; and a tether attached to said shaft and a kill switch that is activated when said tether is pulled;

wherein the propulsion device is a stand-alone device that is manually operated in a body of water.

2. The propulsion device of claim 1 wherein said paddle blade is connected to said first end of said shaft by a lockable pivot joint.

3. The propulsion device of claim 1 wherein said power source is housed inside said shaft.

4. The propulsion device of claim 1 wherein said paddle blade has an integral housing formed thereon, said motor being mounted inside housing.

5. The propulsion device of claim 4 wherein said paddle blade has an opening formed therein adjacent to said housing, said propeller being located in said opening.

6. The propulsion device of claim 1 wherein said paddle blade is made of a buoyant material.

7. The propulsion device of claim 1 wherein said shaft comprises two sections joined together by a quick connect coupling.

8. A propulsion device comprising an elongated handle having a longitudinal axis and a radial dimension;

a paddle blade connected to a first end of said handle, said paddle blade having a blade surface with a width dimension that is substantially greater than a thickness dimension the paddle blade serving to control direction of travel of a watercraft in water;

an electric motor mounted on said paddle blade;

a propeller attached to said electric motor;

a tether attached to said shaft and a kill switch that is activated when said tether is pulled; and a power source electrically connected to said motor;

wherein said paddle blade is oriented at an oblique angle relative said elongated handle, such that said width dimension and said thickness dimension, when extended in their respective planes, do not intersect with said elongated handle; and wherein the propulsion device is a stand-alone device that is manually operated in a body of water.

9. The propulsion device of claim 8, wherein said oblique angle is in the range between about 120 to 140 degrees.

10. The propulsion device of claim 8 wherein said paddle blade has an integral housing formed thereon, said motor being mounted inside said housing.

11. The propulsion device of claim 10 wherein said paddle blade has an opening formed therein adjacent to said housing, said propeller being located in said opening.

12. A propulsion device comprising:

a shaft;

a paddle blade pivotably connected to a first end of said shaft for controlling direction of travel of a watercraft in water:

an electric motor mounted on said paddle blade;

a propeller attached to said electric motor;

a power source electrically connected to said motor; and a water sensor mounted on said paddle blade, wherein said motor can be activated only when said water sensor is submerged in water;

wherein the propulsion device is a stand-alone device that is manually operated in a body of water.

13. The propulsion device of claim 12 wherein said paddle blade is connected to said first end of said shaft by a lockable pivot joint.

14. The propulsion device of claim 12 wherein said power source is housed inside said shaft.

15. The propulsion device of claim 12 wherein said paddle blade has an integral housing formed thereon, said motor being mounted inside housing.

16. The propulsion device of claim 15 wherein said paddle blade has an opening formed therein adjacent to said housing, said propeller being located in said opening.

17. The propulsion device of claim 12 wherein said paddle blade is made of a buoyant material.

18. The propulsion device of claim 12 wherein said shaft comprises two sections joined together by a quick connect coupling.

* * * * *